US005218151A

United States Patent [19]

Kurosaki

[11] Patent Number: 5,218,151

[45] Date of Patent: Jun. 8, 1993

[54] HI-HAT CYMBAL HOLDER

[75] Inventor: Makoto Kurosaki, Hamamatsu, Japan

[73] Assignee: Yamaha Corporation, Hamamatsu, Japan

[21] Appl. No.: 811,090

[22] Filed: Dec. 20, 1991

[30] Foreign Application Priority Data

Dec. 25, 1990 [JP] Japan ..... 2-404563[U]

[51] Int. Cl.[5] ..... G10D 13/00; A47G 29/00

[52] U.S. Cl. ..... 84/422.3; 248/125

[58] Field of Search ..... 84/422.3, 422.2; 403/108, 109; 411/389, 408; 248/125, 354.3

[56] References Cited

U.S. PATENT DOCUMENTS 619,516 2/1899 Tillotson ..... 411/389

5,018,426 5/1991 Suzuki ..... 84/422.3

*Primary Examiner*—Michael L. Gellner

*Assistant Examiner*—Cassandra Spyrou

*Attorney, Agent, or Firm*—Cobrin Gittes & Samuel

[57] ABSTRACT

In construction of a hi-hat cymbal holder for upper and lower cymbal plates, an extension rod holding the upper cymbal plate is supported at its lower end by a bush in a holder unit, the lower cymbal plate is supported stationarily by the holder unit and a rotary ring of a gap adjuster nut is mounted to the holder unit so that its rotation causes up and down movement of the extension rod via the bush. For cymbal gap adjustment, the rotary ring is manually rotated in the opening or closing direction so as to move, via the bush and the extension rod, the upper cymbal plate with respect to the lower cymbal plate. The adjuster nut is located close to the position of a player during performance and its rotary ring can be easily operated by one hand of the player only without disturbing stick operation by the other hand.

4 Claims, 2 Drawing Sheets

HI-HAT CYMBAL HOLDER

BACKGROUND OF THE INVENTION

The present invention relates to a hi-hat cymbal holder, and more particularly relates to an improvement in operability of a hi-hat cymbal holder used for adjusting the distance between upper and lower cymbal plates (hereinafter called "cymbal gap") which are held thereby.

In general operation for plying a hi-hat cymbal, a foot pedal is stepped to make the upper cymbal plate strike on the lower cymbal plate, or either or both cymbal plates are struck with a drum stick whilst closing or opening the two cymbal plates. In the case of a twin bass system wherein a pair of bass drums are used in combination, however, player's feet are occupied by two sets of foot pedals for the drums and, as a consequence, cannot be used for stepping a cymbal foot pedal for closing the two cymbal plates. Stated otherwise, it is impossible to strike the cymbal plates in the closed state with a drum stick.

Several proposals have already been made in an attempt to remove such inconveniences in operation of a hi-hat cymbal. For example, proposals are made in Japanese Utility Model Opening Hei. 1-60258 and Japanese Patent Publication Sho. 62-38711.

In the case of the hi-hat cymbal disclosed in Japanese Utility Model Opening Hei. 1-60258, a lower cymbal receiver is mounted near the lower end of a shaft held by a cymbal stand and an upper cymbal receiver is slidably mounted near the upper end of the shaft. A spring is arranged below the upper cymbal receiver so as to urge the upper cymbal receiver upwards. A nut accompanied with a handle is arranged above the upper cymbal receiver in screw engagement with a screw formed near the upper end of the shaft in order to urge the upper cymbal receiver downwards. Cymbal gap is adjusted by turning the nut via the handle to move the upper cymbal plate vertically. In case one needs to adjust the cymbal gap on this construction while continuing stick striking performance, it is very difficult to practice the cymbal gap adjustment because the nut with the handle is located near the position on the upper cymbal plate to be struck by a drum stick.

In the construction of the hi-hat cymbal disclosed in Japanese Patent Publication Sho. 62-38711, a stand pipe holds a lower cymbal plate at its upper end and a supporting rod for an upper cymbal plate is slidably mounted to the stand pipe via an elastic body unit whilst being urged upwards. The supporting rod is slightly slidable by operation of a screw mechanism arranged near the bottom of the stand pipe. Gap adjustment is carried out by turning the screw mechanism. In case one needs to adjust the cymbal gap on this construction while continuing stick striking performance, it is also very difficult to practice the cymbal gap adjustment because the screw mechanism is located remote from the position of the player.

SUMMARY OF THE INVENTION

It is the primary object of the present invention to enable easy cymbal gap adjustment while continuing stick striking performance on a hi-hat cymbal.

According to the basic aspect of the present invention, an extension rod supports an upper cymbal plate at its upper end, a holder unit supporting the lower end of the extension rod is detachably coupled at its lower end to a cymbal stand, a cover is coupled to the front side of the holder unit, a gap adjuster nut is rotatably coupled to the body of the holder unit, and means for urging the extension rod is arranged in the holder unit.

DESCRIPTION OF THE PREFERRED EMBODIMENTS

Figure 1:
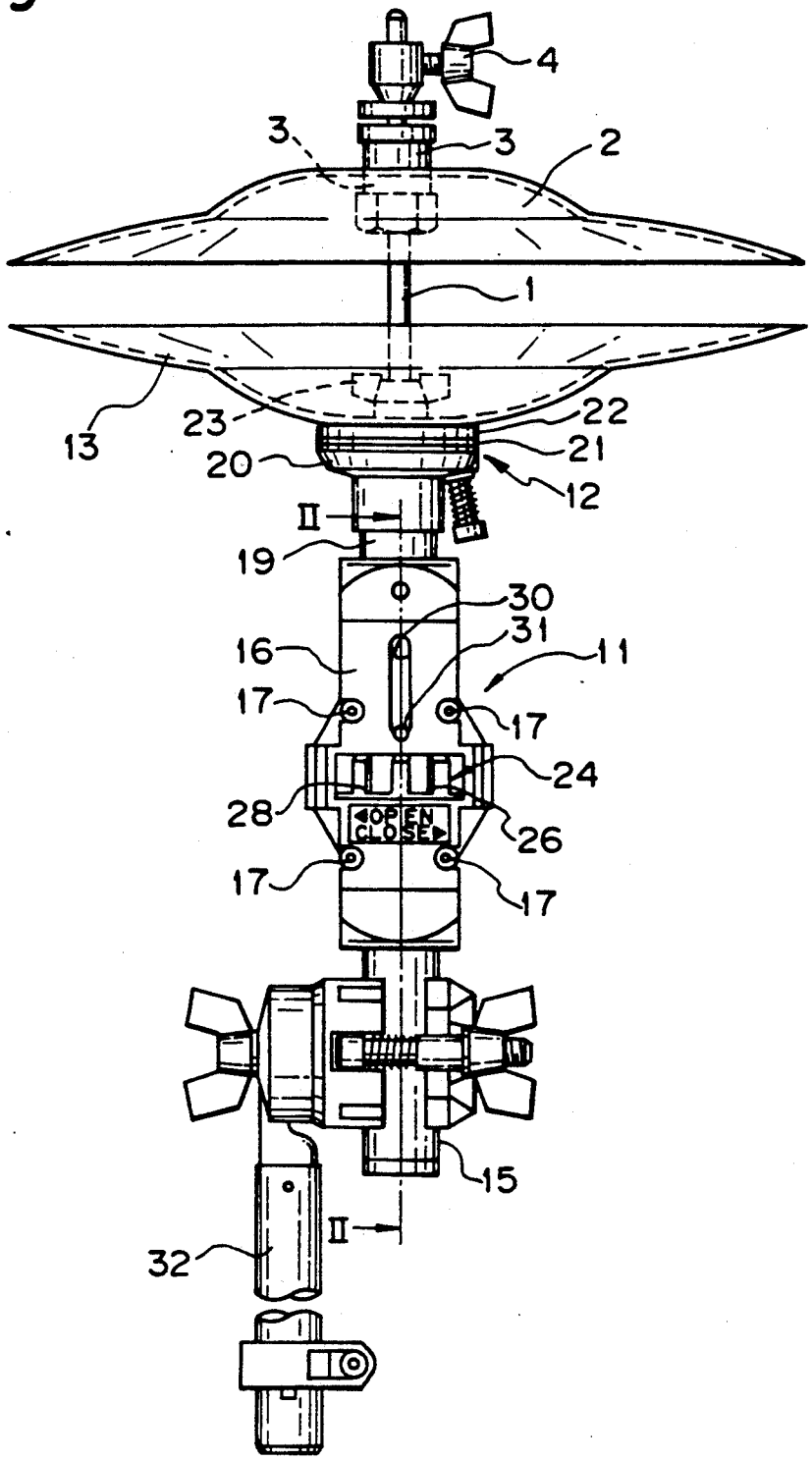
FIG. 1 is a front view of one embodiment of the hi-hat cymbal holder in accordance with the present invention.

In FIG. 1, the hi-hat cymbal holder in accordance with the present invention includes, as major components, an extension rod 1 supporting an upper cymbal plate at its upper end, a tubular holder unit 11 supporting the lower end of the extension rod and detachably coupled at its lower end to a cymbal stand, a cover 16 coupled to the front side of the holder unit 11, a gap adjuster nut 24 rotatably coupled to the body of the holder unit 11, means arranged in the holder unit 11 for urging the extension rod upwards, and a lower cymbal supporter unit 12 mounted atop the holder unit 11.

On the extension rod 1, the upper cymbal plate 2 is sandwiched by a pair of felt washers 3 and fastened to the extension rod 1 by means of a fastener screw 4.

Figure 2:
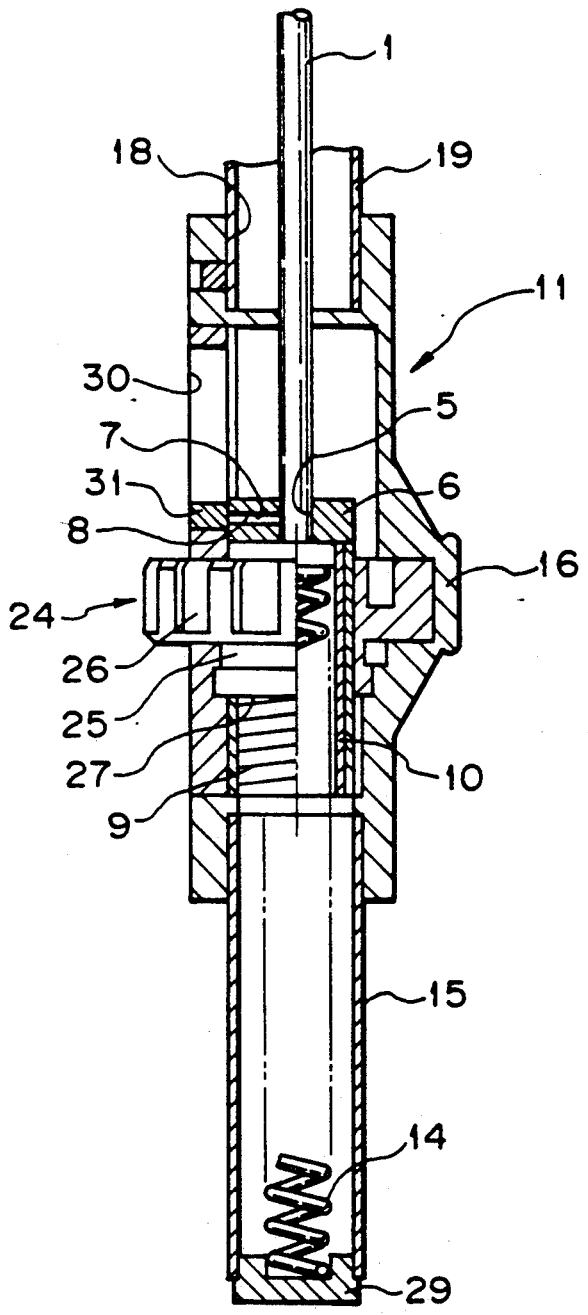
FIG. 2 is a section taken along a line II—II in FIG. 1.

As best seen in FIG. 2, the lower end of the extension rod 1 is placed in screw engagement with a threaded axial hole 5 formed in a bush 6 received in the holder unit 11. A threaded radial hole 7 is formed in the bush 6 in communication with the axial hole 5 and a stopper screw 8 is screwed into the radial hole 7 whilst abutting against the periphery of the extension rod 1.

Below the bush 6, an adjuster sleeve 10 having a male thread 9 is inserted into the holder unit 11 coaxially with the extension rod 1. The extension rod 1 extends upwards beyond the upper end of the holder unit 11 and coaxially through the lower cymbal supporter unit 12.

The holder unit 11 is accompanied with a lower cymbal supporter unit 12 on its upper side and with a spring holder 15 on its lower side. The spring holder 15 internally accommodates a compression spring 14 acting as the means for urging the extension rod 1 upwards. A cover 16 is secured to the front side of the holder unit 11 by means of a plurality of set bolts 17.

The lower cymbal supporter unit 12 includes a tubular post 19 inserted into a socket hole 18 formed in the upper section of the holder unit 11 and a cymbal receiver 20 attached to the upper section of the tubular post 19. The cymbal receiver 20 supports the lower cymbal plate 13 via a receiver fiber 21 and a felt washer 22 and the lower cymbal plate 13 is fastened thereto by means of fastener nut 23 arranged on the inner face of the lower cymbal plate 13 as shown in FIG. 1.

A gap adjuster nut 24 is rotatably coupled to the body of the holder unit 11. This adjuster nut 24 is made up of a tube 25 and rotary ring 26 secured to one side, i.e. the front side of the holder unit 11, of the tube 25. Vertical indentations are formed on the periphery of the rotary ring 26. The tube 25 is provided with a female thread 27 in screw engagement with the male thread 9 formed on the adjuster sleeve 10. A part of the rotary ring 26 is exposed outside the cover 16 through a window 28 formed in the body of the cover 16. As shown in FIG. 1, indications are given with arrows on the outer periphery of the cover 16 in order to show the opening and closing directions of the cymbal plates 2 and 13.

When the rotary ring 26 is rotated in the opening direction, i.e. leftwards in FIG. 1, the outer face of the tube 25 slides against the inner face of the holder unit 11 and the adjuster sleeve 10 in screw engagement with the tube 25 moves upwards. On the contrary, when the rotary ring 26 is rotated in the closing direction, i.e. rightward in FIG. 1, the outer face of the tube slides against the inner face of the holder unit 11 and the adjuster sleeve 10 moves downwards. As the adjuster sleeve 10 moves upwards, the extension rod 1 is also pushed upwards and the upper cymbal plate 2 moves upwards away from the lower cymbal plate 13 to open the cymbal plates. Whereas downward movement of the adjuster sleeve 10 pulls the extension rod 1 downwards and the upper cymbal plate 3 moves downwards towards the lower cymbal plate 13 to close the cymbal plates. The degree of the cymbal gap can be quite freely adjusted by changing the degree of rotation of the rotary ring 26.

The spring 14 in the tubular spring holder 5 abuts against the lower face of the bush 6 at its upper end and, at its lower end, against a spring seat 29 secured to the lower end of the spring holder 5. In other words, the adjuster sleeve 10 and the extension rod 1 are always urged upwards by the spring 14 via the bush 6.

As shown in FIG. 1, a vertical slot 30 is formed in the upper section of the cover 16 so that a guide spacer 31 in the slot 30 abuts against the adjuster sleeve 10 in order to lock the same against rotation.

As is clear from the foregoing description, cymbal gap adjustment can be carried out very easily and simply by rotating, via one hand operation, the rotary ring 26 located below the lower cymbal supporter unit 12. This location is very close to the position of the player urging performance. In addition the other hand of the player is left quite free during this cymbal gap adjustment and, as a consequence, can be used for operating a drum stick. Stated otherwise, stick appertain is not hindered by the cymbal gap adjustment at all. Further, since the extension rod 1 is always urged upwards by the spring 14 and the adjuster sleeve 10 connected to the extension rod 1 is moved up and down by means of the rotary ring 26, the cymbal adjustment can be carried out with high degree of precision. Being completely encased within the spring holder 15, presence of the spring 14 generates no resonant sounds which would otherwise disturb performance.

I claim:

1. A hi-hat cymbal holder mounted on a cymbal stand and holding upper and lower cymbal plates, said holder comprising an extension rod having an upper end and a lower end, said upper end of said extension rod supporting said upper cymbal plate, a holder unit supporting said lower end of said extension rod, said holder unit including a lower end and a body, said lower end of said holder unit being detachably coupled to said cymbal stand, a tubular cover coupled to said body of said holder unit, a cymbal gap adjuster nut rotatably coupled to said body of said holder unit for manual rotation about a substantially vertical axis of said holder unit, said nut having a tubular lower extension, said lower extension having a female thread, an adjuster sleeve arranged within said cover in a concentric arrangement with said gap adjuster nut for supporting said extension rod, said adjuster sleeve having a male thread in threaded engagement with said female thread on said lower extension of said gap adjuster nut, said adjuster sleeve being axially movable within said lower extension in response to rotation of said cymbal gap adjuster nut, and means for urging said extension rod upwards.

2. A hi-hat cymbal holder as claimed in claim 1 in which said extension rod is secured to a bushing arranged within said cover in a vertically moveable arrangement, and said means for urging said extension rod upwards includes a tubular spring holder disposed at a lower end of said cover, and a compression spring disposed in said tubular spring holder, said compression spring being interposed between said bushing and a closed bottom end of said tubular spring holder.

3. A hi-hat cymbal holder as claimed in claim 1 in which said tubular cover is provided with a vertical slot in which a guide spacer is arranged in contact with said adjuster sleeve so as to lock said adjuster sleeve against rotation.

4. A hi-hat cymbal holder as claimed in claim 1 further comprising a low cymbal supporter unit mounted atop said holder unit and holding said lower cymbal plate.

* * * * *